US006453920B1

(12) United States Patent
Izuchukwu et al.

(10) Patent No.: US 6,453,920 B1
(45) Date of Patent: Sep. 24, 2002

(54) WALKING ASSISTANCE DEVICE INCORPORATING GAS STORAGE VESSEL COMPRISING A POLYMERIC CONTAINER SYSTEM FOR PRESSURIZED FLUIDS

(75) Inventors: John I. Izuchukwu, Wildwood, MO (US); Stan A. Sanders, Chesterfield, MO (US)

(73) Assignee: Mallinckrodt Inc., St. Louis, MO (US)

( * ) Notice: Subject to any disclaimer, the term of this patent is extended or adjusted under 35 U.S.C. 154(b) by 22 days.

(21) Appl. No.: 09/708,040

(22) Filed: Nov. 8, 2000

(51) Int. Cl.[7] ..... A45B 5/00

(52) U.S. Cl. ..... 135/66; 128/204.18; 128/205.22; 222/3; 222/6; 222/206; 135/68

(58) Field of Search ..... 135/66, 68; 128/208.24, 128/202.13, 202.19, 204.18, 205.13, 207.18, 205.22; 272/3, 6, 206, 209, 214, 215

(56) References Cited

U.S. PATENT DOCUMENTS

| | | | | |
|---|---|---|---|---|
| 771,801 | A | | 10/1904 | Andrew |
| 1,288,857 | A | | 12/1918 | Farr |
| 2,380,372 | A | | 7/1945 | Alderfer |
| 3,338,238 | A | | 8/1967 | Warncke |
| 3,432,060 | A | | 3/1969 | Cowley |
| 3,491,752 | A | | 1/1970 | Cowley |
| 4,090,509 | A | | 5/1978 | Smith |
| 4,181,993 | A | | 1/1980 | McDaniel |
| 4,253,454 | A | | 3/1981 | Warncke |
| 4,665,943 | A | | 5/1987 | Medvick et al. |
| 4,800,923 | A | | 1/1989 | Bartos |
| 4,932,403 | A | | 6/1990 | Scholley |
| 4,964,405 | A | | 10/1990 | Arnoth |
| 4,989,599 | A | | 2/1991 | Carter |
| 5,036,845 | A | | 8/1991 | Scholley |
| 5,127,399 | A | | 7/1992 | Scholley |
| 5,323,953 | A | | 6/1994 | Adderley et al. |
| 5,354,029 | A | * | 10/1994 | Ziaylek ..... 248/313 |
| 5,435,305 | A | | 7/1995 | Rankin, Sr. |
| 5,494,469 | A | | 2/1996 | Heath et al. |
| 5,513,789 | A | * | 5/1996 | Woods ..... 135/67 |
| 5,517,984 | A | | 5/1996 | Sanders |
| D370,877 | S | * | 6/1996 | Trujillo ..... D12/133 |
| 5,529,061 | A | | 6/1996 | Sanders |
| 5,582,164 | A | | 12/1996 | Sanders |
| 5,690,096 | A | * | 11/1997 | Burch ..... 128/204.18 |
| 5,810,466 | A | * | 9/1998 | Young ..... 135/66 |
| 5,830,400 | A | | 11/1998 | Huvey et al. |
| 5,839,383 | A | | 11/1998 | Stenning et al. |
| 5,901,723 | A | * | 5/1999 | Ames ..... 135/66 |
| 5,941,839 | A | * | 8/1999 | Ishikawa ..... 128/202.13 |
| 6,003,460 | A | | 12/1999 | Stenning et al. |
| 6,029,833 | A | * | 2/2000 | Conte ..... 135/66 |
| 6,047,860 | A | | 4/2000 | Sanders |
| 6,182,877 | B1 | * | 2/2001 | Rolfe ..... 135/66 |
| 6,220,557 | B1 | * | 4/2001 | Ziaylek ..... 248/316.1 |

FOREIGN PATENT DOCUMENTS

| | | |
|---|---|---|
| DE | 971689 | 3/1959 |
| DE | 2644806 A1 | 4/1978 |
| FR | 1037477 | 9/1953 |
| WO | WO97-11734 A1 | 4/1997 |

* cited by examiner

*Primary Examiner*—Beth A. Stephan
(74) *Attorney, Agent, or Firm*—Rothwell, Figg, Ernst & Manbeck

(57) ABSTRACT

A walking assistance device, for example, a walking cane, a walking crutch, or walker includes a gas storage vessel for providing an ambulatory supply of medicinal gas for a user of the device. The gas storage vessel is formed from a plurality of polymeric hollow chamber having either an ellipsoidal or spherical shape and interconnected by a plurality of relatively narrow conduit sections disposed between consecutive ones of the chambers. The gas storage vessel includes a reinforcing filament wrapped around the interconnected chambers and interconnecting conduit sections to limit radial expansion of the chambers and conduit sections when filled with a fluid under pressure. The container system further includes a fluid transfer control system attached to the gas storage vessel for controlling fluid flow into and out of the gas storage vessel and a gas delivery mechanism for delivering gas from the gas storage vessel to a user in a breathable manner.

17 Claims, 15 Drawing Sheets

WALKING ASSISTANCE DEVICE INCORPORATING GAS STORAGE VESSEL COMPRISING A POLYMERIC CONTAINER SYSTEM FOR PRESSURIZED FLUIDS

FIELD OF THE INVENTION

The present invention is directed to a walking assistance device incorporating a container system for pressurized fluids that is lightweight and flexible.

BACKGROUND OF THE INVENTION

There are many applications for a portable supply of fluid under pressure. For example, SCUBA divers and firefighters use portable, pressurized air supplies. Commercial aircraft employ emergency oxygen delivery systems that are used during sudden and unexpected cabin depressurization. Military aircraft typically require supplemental oxygen supply systems as well. Such systems are supplied by portable pressurized canisters. In the medical field, gas delivery systems are provided to administer medicinal gas, such as oxygen, to a patient undergoing respiratory therapy. Supplemental oxygen delivery systems are used by patients that benefit from receiving and breathing oxygen from an oxygen supply source to supplement atmospheric oxygen breathed by the patient. Not uncommonly, patients in need of respiratory therapy also require the assistance of a walking assistance device such as a walking cane, a walking crutch, or a walker. For such requirements, a compact, portable supplemental oxygen delivery system is useful in a wide variety of contexts, including hospital, home care, and ambulatory settings.

High-pressure supplemental oxygen delivery systems typically include a cylinder or tank containing oxygen gas at a pressure of up to 3,000 psi. A pressure regulator is used in a high-pressure oxygen delivery system to step down the pressure of oxygen gas to a lower pressure (e.g., 20 to 50 psi) suitable for use in an oxygen delivery apparatus used by a person breathing the supplemental oxygen.

In supplemental oxygen delivery systems, and in other applications employing portable supplies of pressurized gas, containers used for the storage and use of compressed fluids, and particularly gases, generally take the form of cylindrical metal bottles that may be wound with reinforcing materials to withstand high fluid pressures. Such storage containers are expensive to manufacture, inherently heavy, bulky, inflexible, and prone to violent and explosive fragmentation upon rupture. Mounting such containers to a walking assistance device so as to provide the patient with an ambulatory supply of oxygen can add significant undesired weight and bulk to the device.

Container systems made from lightweight synthetic materials have been proposed. Scholley, in U.S. Pat. Nos. 4,932,403; 5,036,845; and 5,127,399, describes a flexible and portable container for compressed gases which comprises a series of elongated, substantially cylindrical chambers arranged in a parallel configuration and interconnected by narrow, bent conduits and attached to the back of a vest that can be worn by a person. The container includes a liner, which may be formed of a synthetic material such as nylon, polyethylene, polypropylene, polyurethane, tetrafluoroethylene, or polyester. The liner is covered with a high-strength reinforcing fiber, such as a high-strength braid or winding of a reinforcing material such as Kevlar® aramid fiber, and a protective coating of a material, such as polyurethane, covers the reinforcing fiber.

The design described in the Scholley patents suffers a number of shortcomings which makes it impractical for use as a container for fluids stored at the pressure levels typically seen in portable fluid delivery systems such as SCUBA gear, firefighter's oxygen systems, emergency oxygen systems, and medicinal oxygen systems. The elongated, generally cylindrical shape of the separate storage chambers does not provide an effective structure for containing highly-pressurized fluids. Moreover, such large containers cannot be easily incorporated onto a walking assistance device. Also, the relatively large volume of the storage sections creates an unsafe system subject to possible violent rupture due to the kinetic energy of the relatively large volume of pressurized fluid stored in each chamber.

Accordingly, there is a need for improved container systems made of light weight polymeric material and which are robust and less susceptible to violent rupture and can be easily incorporated within a walking assistance device, such as a walking cane, a walking crutch, or a walker without adding significant weight or bulk.

SUMMARY OF THE INVENTION

In accordance with aspects of the present invention, a walking assistance device includes a gas storage vessel that is robust, unobtrusive, and lightweight. In particular, a walking assistance device providing a portable supply of medicinal gas is disclosed that includes a handle adapted to be grasped by a user, a support structure constructed and arranged to support the handle in a raised position with respect to the ground, and a gas storage vessel carried within the support structure. The gas storage vessel is made up of a plurality of hollow chambers, each chamber having a substantially spherical or ellipsoidal shape and being formed from a polymeric material, a plurality of conduit sections formed from a polymeric material, each conduit section being positioned between adjacent hollow chambers to interconnect the plurality of hollow chambers, each of the conduit sections having a maximum interior transverse dimension that is smaller than a maximum interior transverse dimension of each of the hollow chambers, and a reinforcing filament wrapped around the hollow chambers and the conduit sections.

Other objects, features, and characteristics of the present invention will become apparent upon consideration of the following description and the appended claims with reference to the accompanying drawings, all of which form a part of the specification, and wherein like reference numerals designate corresponding parts in the various figures.

DETAILED DESCRIPTION OF THE INVENTION

With reference to the figures, exemplary embodiments of the invention will now be described. These embodiments illustrate principles of the invention and should not be construed as limiting the scope of the invention.

Figure 1:
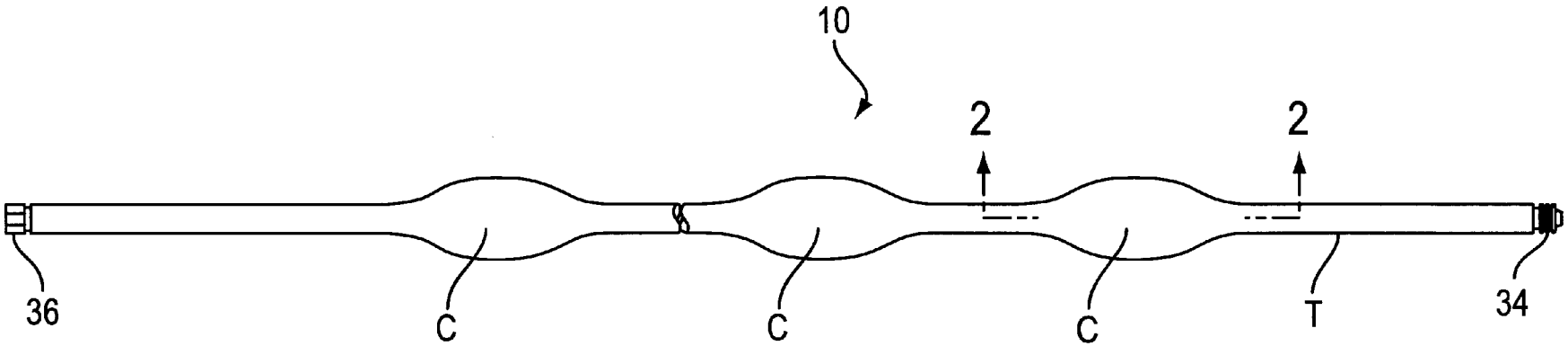
FIG. 1 is a broken side elevational view of a plurality of aligned, rigid, generally ellipsoidal chambers interconnected by a tubular core.

As shown in FIGS. 1 and 2, U.S. Pat. No. 6,047,860 (the disclosure of which is hereby incorporated by reference) to Sanders, an inventor of the present invention, discloses a container system 10 for pressurized fluids including a plurality of formretaining, generally ellipsoidal chambers C interconnected by a tubular core T. The tubular core extends through each of the plurality of chambers and is sealingly secured to each chamber. A plurality of longitudinally-spaced apertures A are formed along the length of the tubular core, one such aperture being disposed in the interior space 20 of each of the interconnected chambers so as to permit infusion of fluid to the interior space 20 during filling and effusion of the fluid from the interior space 20 during fluid delivery or transfer to another container. The apertures are sized so as to control the rate of evacuation of pressurized fluid from the chambers. Accordingly, a low fluid evacuation rate can be achieved so as to avoid a large and potentially dangerous release of kinetic energy should one or more of the chambers be punctured (i.e., penetrated by an outside force) or rupture.

Figure 2A:
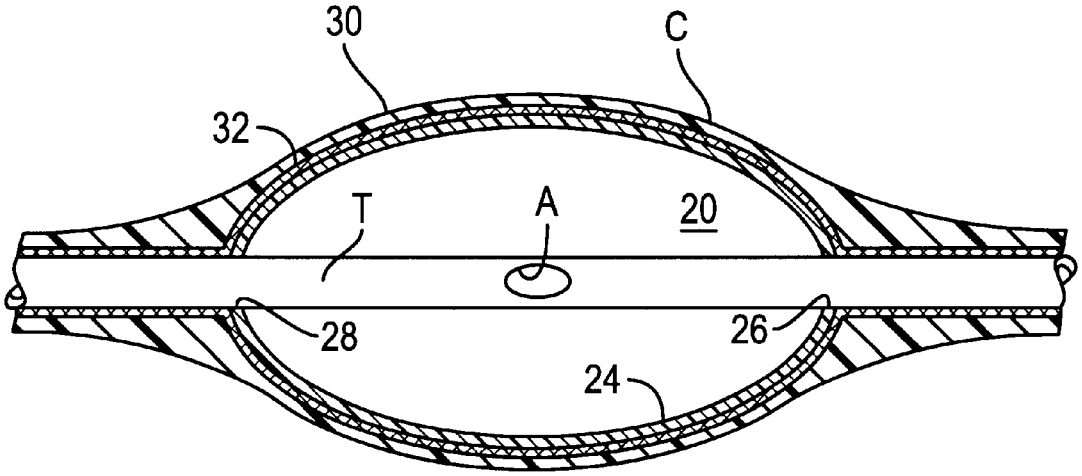
FIG. 2A is an enlarged horizontal sectional view taken along the line A—A in FIG. 1.

The size of the apertures A will depend upon various parameters, such as the volume and viscosity of fluid being contained, the anticipated pressure range, and the desired flow rate. In general, smaller diameters will be selected for gasses as opposed to liquids. Thus, the aperture size may generally vary from about 0.010 to 0.125 inches. Although only a single aperture A is shown in FIG. 2A, more than one aperture A can be formed in the tube T within the interior space 20 of the shell 24. In addition, each aperture A can be formed in only one side of the tube T, or the aperture A may extend through the tube T.

Referring to FIG. 2A, each chamber C includes a generally ellipsoidal shell 24 molded of a suitable synthetic plastic material and having open front and rear ends 26 and 28. The diameters of the holes 26 and 28 are dimensioned so as to snugly receive the outside diameter of the tubular core T. The tubular core T is attached to the shells 24 so as to form a fluid tight seal therebetween. The tubular core T is preferably bonded to the shells 24 by means of light, thermal, or ultrasonic energy, including techniques such as, ultrasonic welding, radio frequency energy, vulcanization, or other thermal processes capable of achieving seamless circumferential welding. The shells 24 may be bonded to the tubular core T by suitable ultraviolet light-curable adhesives, such as 3311 and 3341 Light Cure Acrylic Adhesives available from Loctite Corporation, having authorized distributors throughout the world. The exterior of the shells 24 and the increments of tubular core T between such shells are wrapped with suitable reinforcing filaments 30 to increase the hoop strength of the chambers C and tubular core T and thereby resist bursting of the shells and tubular core. A protective synthetic plastic coating 32 is applied to the exterior of the filament wrapped shells and tubular core T.

More particularly, the shells 24 may be either roto molded, blow molded, or injection molded of a synthetic plastic material such as TEFLON or fluorinated ethylene propylene. Preferably, the tubular core T will be formed of the same material. The reinforcing filaments 30 may be made of a carbon fiber, Kevlar® or Nylon. The protective coating 32 may be made of urethane to protect the chambers and tubular core against abrasions, UV rays, moisture, or thermal elements. The assembly of a plurality of generally ellipsoidal chambers C and their supporting tubular core T can be made in continuous strands of desired length. In the context of the present disclosure, unless stated otherwise, the term "strand" will refer to a discrete length of interconnected chambers.

Figure 2B:
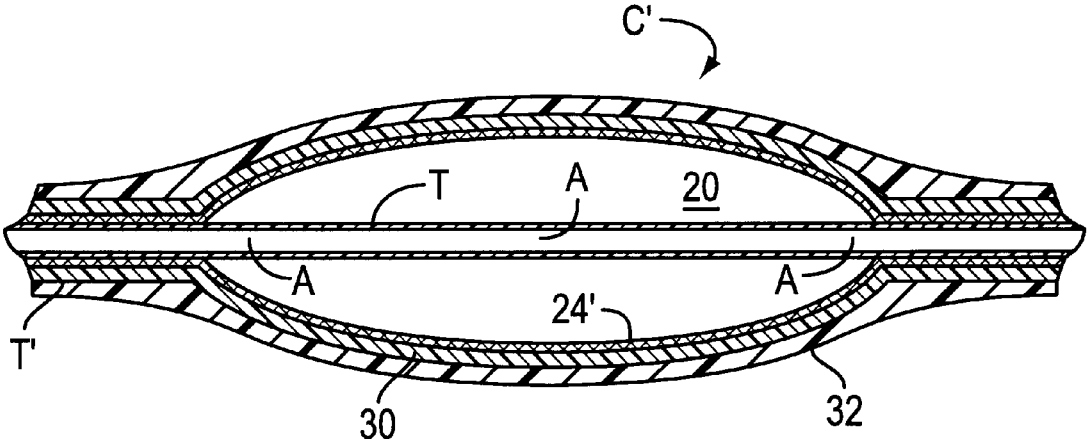
FIG. 2B is an enlarged horizontal sectional view taken along the line A—A in FIG. 1 showing an alternate embodiment.

As shown in FIG. 2B, the tube T can be co-formed, such as by co-extrusion, along with shells 24' and tubular portions T' integrally formed with the shells 24' and which directly overlie the tube T between adjacent shells 24'. Furthermore, as also shown in FIG. 2B, more than one aperture A may be formed in the tube T within the interior 20 of the shell 24'. The co-formed assembly comprised of the shells 24', tubular portions T', and tube T can be wrapped with a layer of reinforcing filaments 30 and covered with a protective coating 32 as described above.

As shown in FIG. 1, the inlet or front end of the tubular core T may be provided with a suitable threaded male fitting 34. The discharge or rear end of a tubular core T may be provided with a threaded female fitting 36. Such male and female fittings provide a pressure-type connection between contiguous strands of assemblies of chambers C interconnected by tubular cores T and provide a mechanism by which other components, such as gauges and valves, can be attached to the interconnected chambers. A preferred structure for attaching such fittings is described below.

Figure 3:
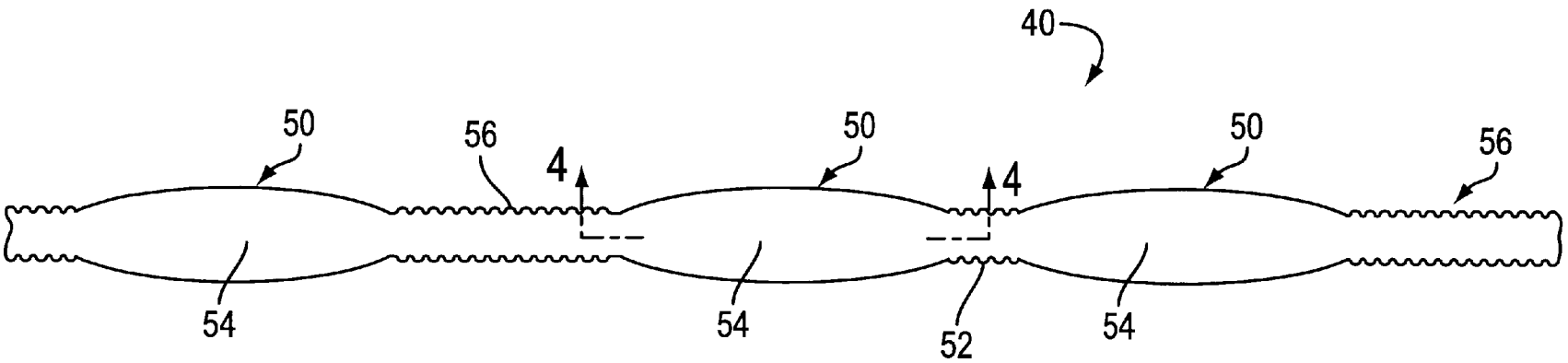
FIG. 3 is a side elevational view of a portion of a container system of the present invention.

A portion of a gas storage vessel constructed in accordance with principles of the present invention is designated generally by reference number 40 in FIG. 3. The gas storage vessel 40 includes a plurality of fluid storage chambers 50 having a preferred ellipsoidal shape and having hollow interiors 54. The individual chambers 50 are pneumatically interconnected with each other by connecting conduit sections 52 and 56 disposed between adjacent ones of the chambers 50. Conduit sections 56 are generally longer than the conduit sections 52. The purpose of the differing lengths of the conduit sections 52 and 56 will be described in more detail below.

Figure 4:
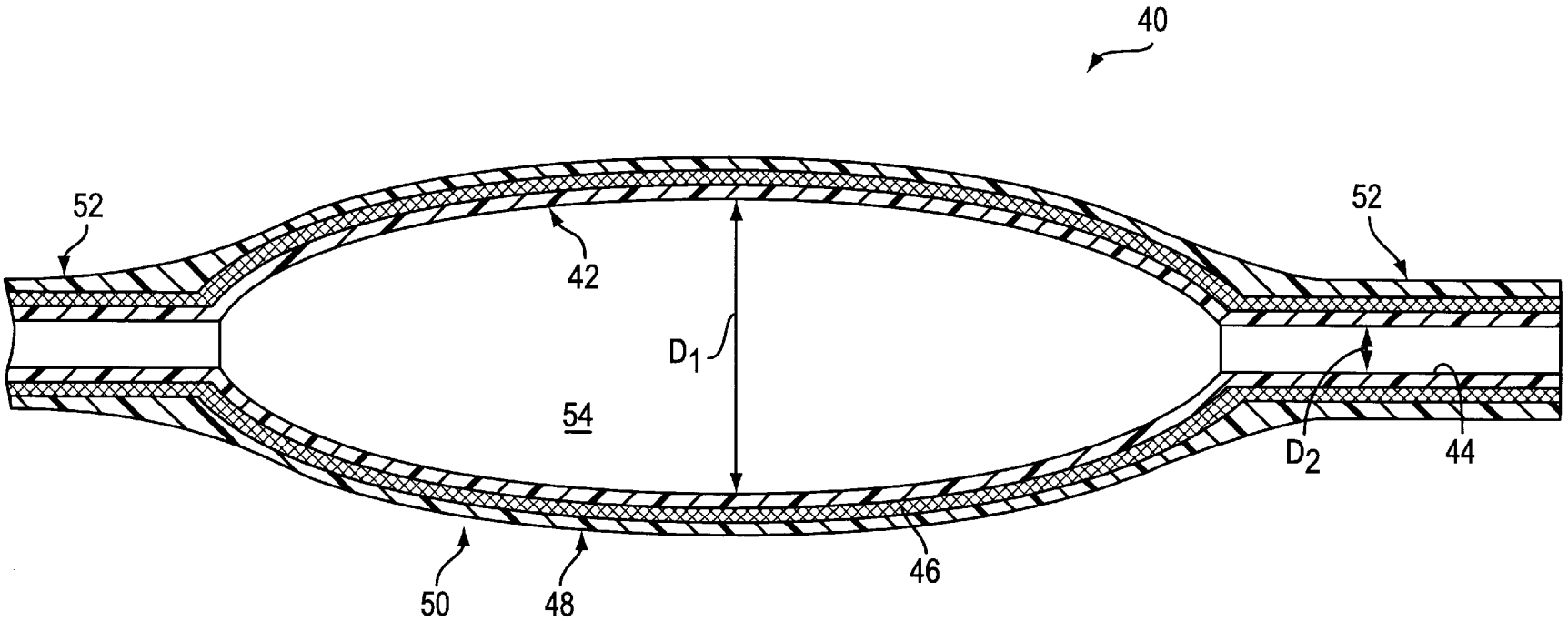
FIG. 4 is a partial longitudinal sectional view along line 4—4 in FIG. 3.

FIG. 4 shows an enlarged longitudinal section of a single hollow chamber 50 and portions of adjacent conduit sections 52 of the gas storage vessel 40. The gas storage vessel 40 preferably has a layered construction including polymeric hollow shells 42 with polymeric connecting conduits 44 extended from opposed open ends of the shells 42. The gas storage vessel 40 includes no tubular core, such as tubular core T shown in FIGS. 2A and 2B, extending through the hollow shells 42.

The polymeric shells 42 and the polymeric connecting conduits 44 are preferably formed from a synthetic plastic material such as Teflon or fluorinated ethylene propylene and may be formed by any of a number of known plastic-forming techniques such as extrusion, roto molding, chain blow molding, or injection molding.

Materials used for forming the shells 42 and connecting conduits 44 are preferably moldable and exhibit high tensile strength and tear resistance. Most preferably, the polymeric hollow shells 42 and the polymeric connecting conduits 44 are formed from a thermoplastic polyurethane elastomer manufactured by Dow Plastics under the name Pellethane® 2363-90AE, a thermoplastic polyurethane elastomer manufactured by the Bayer Corporation, Plastics Division under the name Texin® 5286, a flexible polyester manufactured by Dupont under the name Hytrel®, or polyvinyl chloride from Teknor Apex.

In a preferred configuration, the volume of the hollow interior 54 of each chamber 50 is within a range of capacities configurable for different applications, with a most preferred volume of about thirty (30) milliliters. It is not necessary that each chamber have the same dimensions or have the same capacity. It has been determined that a gas storage vessel 40 having a construction as will be described below will undergo a volume expansion of 7–10% when subjected to an internal pressure of 2000 psi. In a preferred configuration, the polymeric shells 42 each have a longitudinal length of about 3.0–3.5 inches, with a most preferred length of 3.250–3.330 inches, and a maximum outside diameter of about 0.800 to 1.200 inches, with a most preferred diameter of 0.095–1.050 inches. The conduits 44 have an inside diameter $D_2$ preferably ranging from 0.125–0.300 inches with a most preferred range of about 0.175–0.250 inches. The hollow shells 42 have a typical wall thickness ranging from 0.03 to 0.05 inches with a most preferred typical thickness of about 0.04 inches. The connecting conduits 44 have a wall thickness ranging from 0.03 to 0.10 inches and preferably have a typical wall thickness of about 0.040 inches, but, due to the differing amounts of expansion experienced in the hollow shells 42 and the conduits 44 during a blow molding forming process, the conduits 44 may actually have a typical wall thickness of about 0.088 inches.

The exterior surface of the polymeric hollow shells 42 and the polymeric connecting conduits 44 is preferably wrapped with a suitable reinforcing filament fiber 46. Filament layer 46 may be either a winding or a braid (preferably a triaxial braid pattern having a nominal braid angle of 75 degrees) and is preferably a high-strength aramid fiber material such as Kevlar® (preferably 1420 denier fibers), carbon fibers, or nylon, with Kevlar® being most preferred. Other potentially suitable filament fiber material may include thin metal wire, glass, polyester, or graphite. The Kevlar winding layer has a preferred thickness of about 0.035 to 0.055 inches, with a thickness of about 0.045 inches being most preferred.

A protective coating 48 may be applied over the layer of filament fiber 46. The protective coating 48 protects the shells 42, conduits 44, and the filament fiber 46 from abrasions, UV rays, thermal elements, or moisture. Protective coating 32 is preferably a sprayed-on synthetic plastic coating. Suitable materials include polyvinyl chloride and polyurethane. The protective coating 32 may be applied to the entire gas storage vessel 40, or only to more vulnerable portions thereof. Alternatively, the protective coating 32 could be dispensed with altogether if the gas storage vessel 40 is encased in a protective, moisture-impervious housing.

The inside diameter $D_1$ of the hollow shell 42 is preferably much greater than the inside diameter $D_2$ of the conduit section 44, thereby defining a relatively discrete storage chamber within the hollow interior 54 of each polymeric shell 42. This serves as a mechanism for reducing the kinetic energy released upon the rupturing of one of the chambers 50 of the gas storage vessel 40. That is, if one of the chambers 50 should rupture, the volume of pressurized fluid within that particular chamber would escape immediately. Pressurized fluid in the remaining chambers would also move toward the rupture, but the kinetic energy of the escape of the fluid in the remaining chambers would be regulated by the relatively narrow conduit sections 44 through which the fluid must flow on its way to the ruptured chamber. Accordingly, immediate release of the entire content of the gas storage vessel is avoided.

Figure 5A:
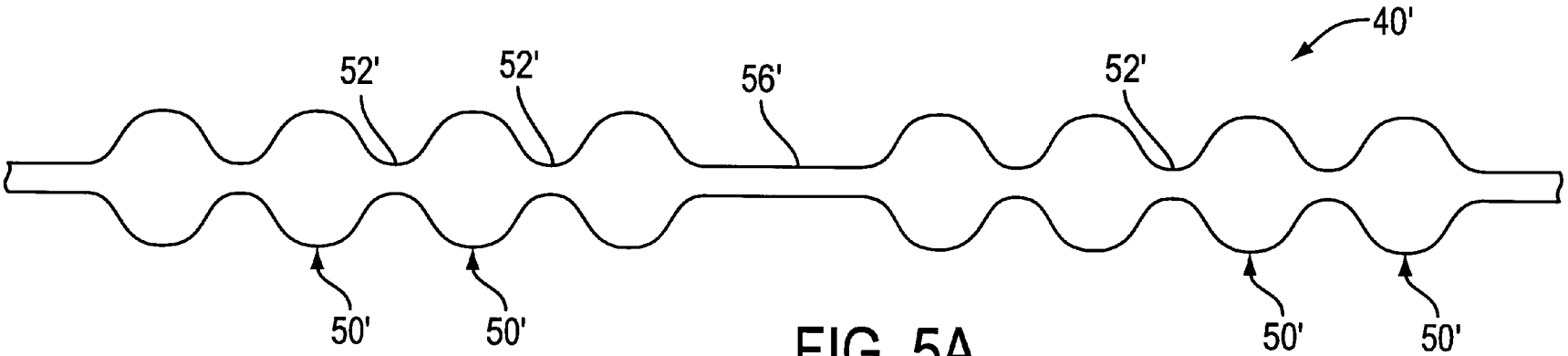
FIG. 5A is a side elevational view of an alternative embodiment of the container system of the present invention.
Figure 5B:
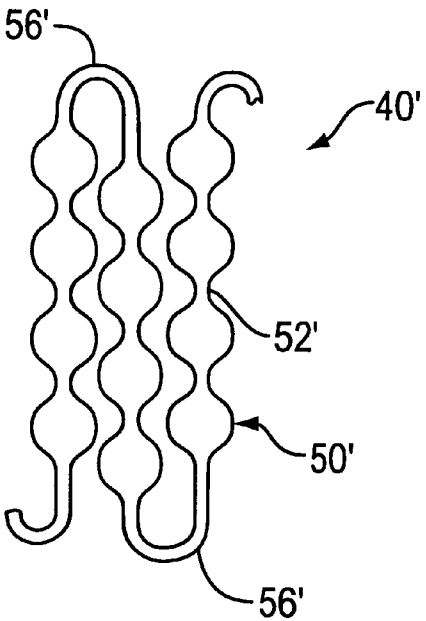
FIG. 5B is a partial view of the container system of FIG. 5A arranged in a sinuous configuration.

An alternate gas storage vessel 40' is shown in FIGS. 5A and 5B. Gas storage vessel 40' includes a plurality of hollow chambers 50' having a generally spherical shape connected by conduit sections 52' and 56'. As shown in FIG. 5B, one particular configuration of the gas storage vessel 40' is to bend it back-and-forth upon itself in a sinuous fashion. The gas storage vessel 40' is bent at the elongated conduit sections 56', which are elongated relative to the conduit sections 52' so that they can be bent without kinking or without adjacent hollow chambers 50' interfering with each other. Accordingly, the length of the conduit sections 56' can be defined so as to permit the gas storage vessel to be bent thereat without kinking and without adjacent hollow chambers 50' interfering with each other. In general, a connecting conduit section 56' of sufficient length can be provided by omitting a chamber 50' in the interconnected series of chambers 50'. The length of a long conduit section 56', however, need not necessarily be as long as the length of a single chamber 50'.

Both ellipsoidal and the spherical chambers are preferred, because such shapes are better suited than other shapes, such as cylinders, to withstand high internal pressures. Spherical chambers 50' are not, however, as preferable as the generally ellipsoidal chambers 50 of FIGS. 3 and 4, because, the more rounded a surface is, the more difficult it is to apply a consistent winding of reinforcing filament fiber. Filament fibers, being applied with axial tension, are more prone to slipping on highly rounded, convex surfaces.

A portable pressure pack 60 employing a gas storage vessel 40 as described above is shown in FIG. 6. Note that the pressure pack 60 includes a gas storage vessel 40 having generally ellipsoidal hollow chambers 50. It should be understood, however, that a gas storage vessel 40 of a type having generally spherical hollow chambers as shown in FIGS. 5A and 5B could be employed in the pressure pack 60 as well. The gas storage vessel 40 is arranged as a continuous, serial strand 58 of interconnected chambers 50 bent back-and-forth upon itself in a sinuous fashion with all of the chambers lying generally in a common plane. In general, the axial arrangement of any strand of interconnected chambers can be an orientation in any angle in X-Y-Z Cartesian space. Note again, in FIG. 6, that elongated conduit sections 56 are provided. Sections 56 are substantially longer than conduit sections 52 and are provided to permit the gas storage vessel 40 to be bent back upon itself without kinking the conduit section 56 or without adjacent chambers 50 interfering with one another. Again, an interconnecting conduit 56 of sufficient length for bending can be provided by omitting a chamber 50 from the strand 58 of interconnected chambers.

The gas storage vessel 40 is encased in a protective housing 62. Housing 62 may have a handle, such as an opening 64, provided therein.

A fluid transfer control system 76 is pneumatically connected to the gas storage vessel 40 and is operable to control transfer of fluid under pressure into or out of the gas storage vessel 40. In the embodiment illustrated in FIG. 6, the fluid transfer control system includes a one-way inlet valve 70 (also known as a fill valve) pneumatically connected (e.g., by a crimp or swage) to a first end 72 of the strand 58 and a one-way outlet valve regulator 66 pneumatically connected (e.g., by a crimp or swage) to a second end 74 of the gas storage vessel 40. In general, the one-way inlet valve 70 includes a mechanism permitting fluid to be transferred from a pressurized fluid fill source into the gas storage vessel 40 through one-way inlet valve 70 and to prevent fluid within the gas storage vessel 40 from escaping through the one-way inlet valve 70. Any suitable one-way inlet valve, well known to those of ordinary skill in the art, may be used.

The outlet valve regulator 66 generally includes a well known mechanism permitting the outlet valve regulator 66 to be selectively configured to either prevent fluid within the gas storage vessel 40 from escaping the vessel through the outlet valve regulator 66 or to permit fluid within the gas storage vessel 40 to escape the vessel in a controlled manner through the outlet valve regulator 66. Preferably, the outlet valve regulator 66 is operable to step down the pressure of fluid exiting the gas storage vessel 40. For example, in typical medicinal applications of ambulatory oxygen, oxygen may be stored within the tank at up to 3,000 psi, and a regulator is provided to step down the outlet pressure to 20 to 50 psi. The outlet valve regulator 66 may include a manually-operable control knob 68 for permitting manual control of a flow rate therefrom. Any suitable regulator valve, well known to those of ordinary skill in the art, may be used.

Preferred inlet and outlet valves are described below.

A pressure relief valve (not shown) is preferably provided to accommodate internal pressure fluctuations due to thermal cycling or other causes.

Figure 6:
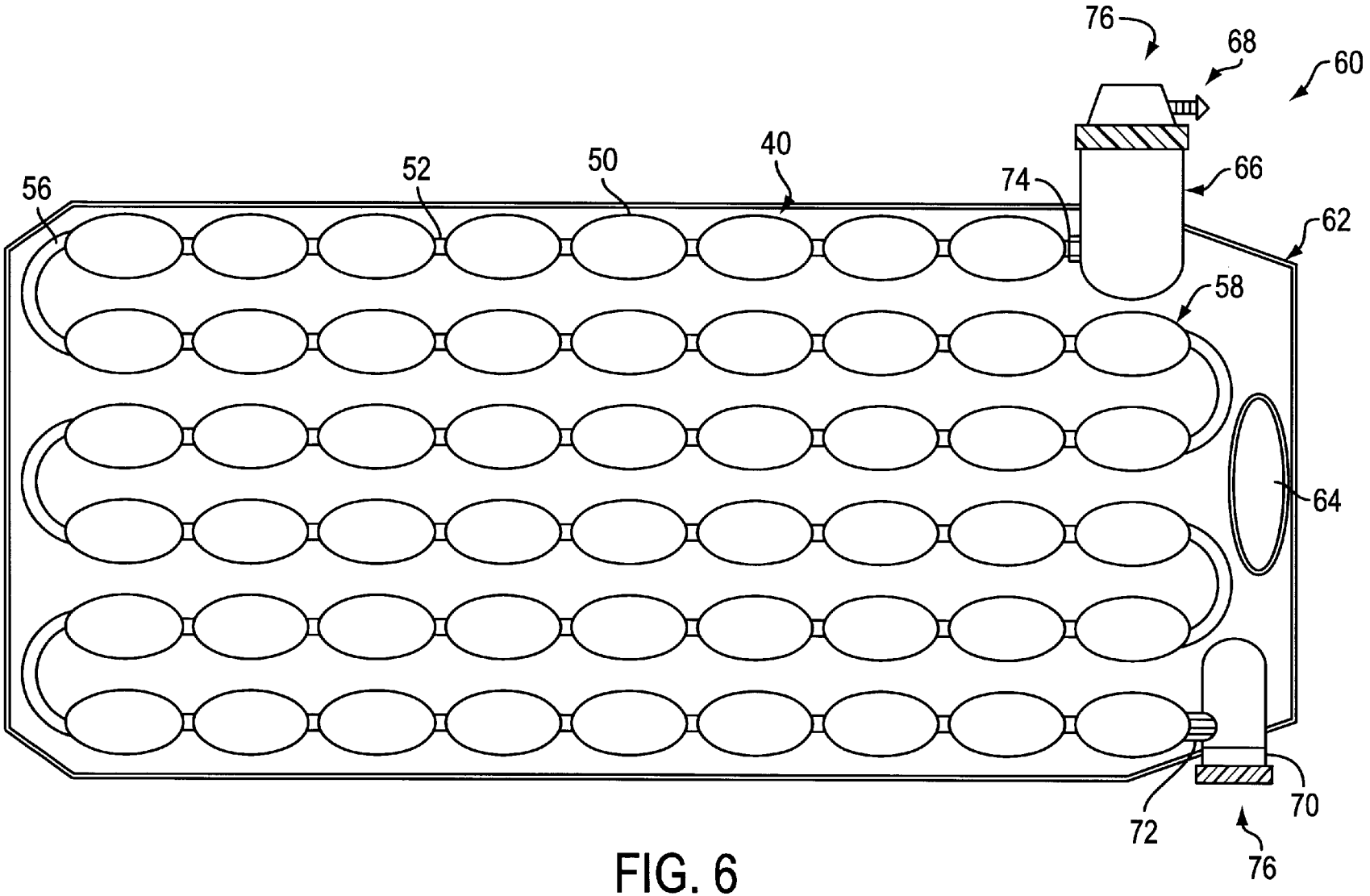
FIG. 6 is a portable pressurized fluid pack employing a container system according to the present invention.

In FIG. 6, the gas storage vessel 40, one-way inlet valve 70, and the outlet valve regulator 66 are shown exposed on top of the housing 62. Preferably, the housing comprises dual halves of, for example, preformed foam shells as will be described in more detail below. For the purposes of illustrating the structure of the embodiment of FIG. 6, however, a top half of the housing 62 is not shown. It should be understood, however, that a housing would substantially encase the gas storage vessel 40 and at least portions of the outlet valve regulator 66 and the one-way inlet valve 70.

Figure 7:
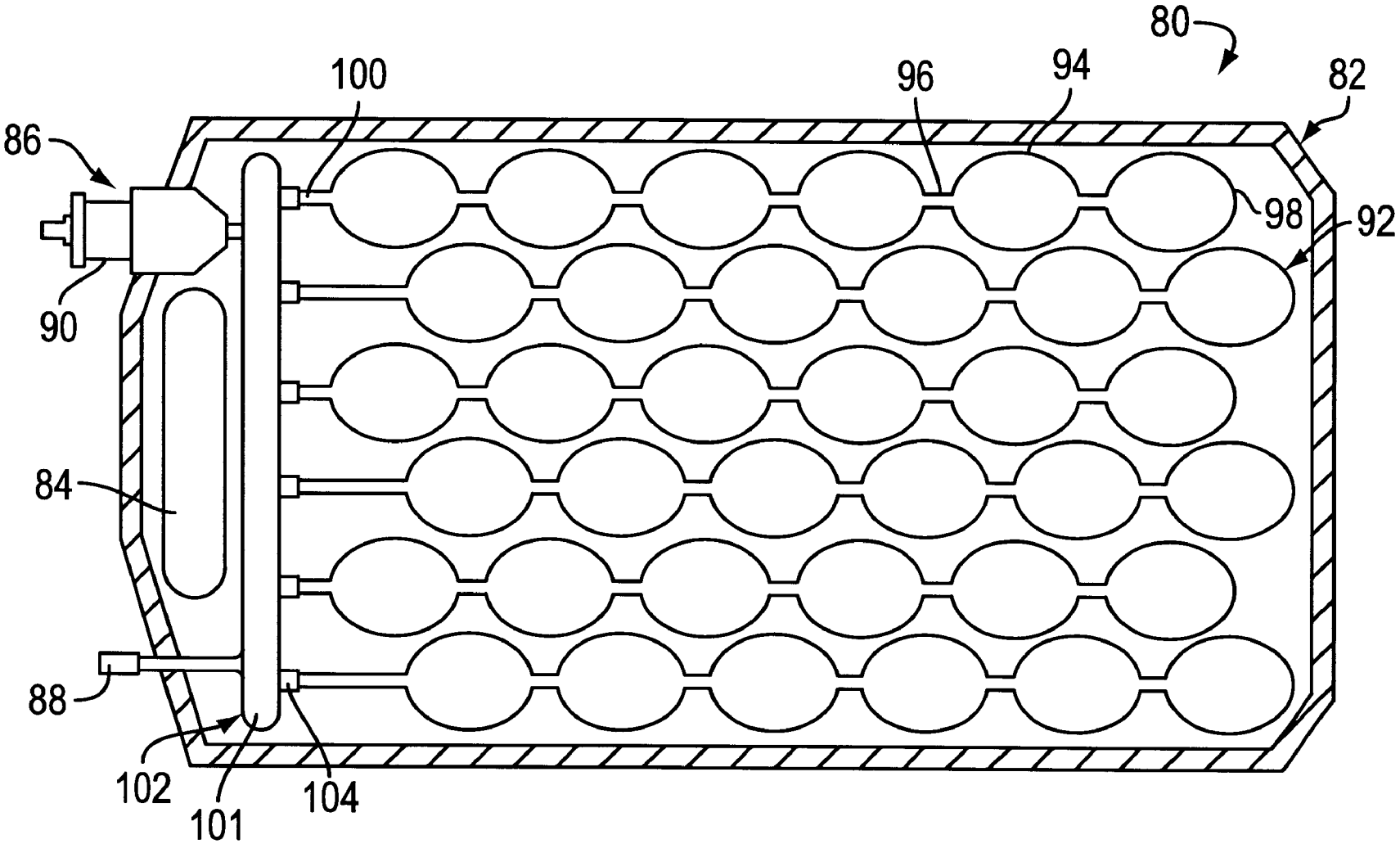
FIG. 7 is an alternate embodiment of a pressurized fluid pack employing the container system of the present invention.

FIG. 7 shows an alternate embodiment of a portable pressure pack generally designated by reference number 80. The pressure pack 80 includes a gas storage vessel formed by a number of strands 92 of individual chambers 94 serially interconnected by interconnecting conduit sections 96 and arrange generally in parallel to each other. In the embodiment illustrated in FIG. 7, the gas storage vessel includes six individual strands 92, but the pressure pack may include fewer than or more than six strands.

Each of the strands 92 has a first closed end 98 at the endmost of the chambers 94 of the strand 92 and an open terminal end 100 attached to a coupling structure defining an inner plenum, which, in the illustrated embodiment, comprises a distributor 102. The distributor 102 includes an elongated, generally hollow body 101 defining the inner plenum therein. Each of the strands 92 of interconnected chambers is pneumatically connected at its respective terminal end 100 by a connecting nipple 104 extending from the elongated body 101, so that each strand 92 of interconnected chambers 94 is in pneumatic communication with the inner plenum inside the distributor 102. Each strand 92 may be connected to the distributor 102 by a threaded interconnection, a crimp, or a swage, or any other suitable means for connecting a high pressure polymeric tube to a rigid fitting. A fluid transfer control system 86 is pneumatically connected to the distributor 102. In the illustrated embodiment, the fluid transfer control system 86 includes a one-way inlet valve 88 and a one-way outlet regulator 90 pneumatically connected at generally opposite ends of the body 101 of the distributor 102.

The strands 92 of interconnected chambers 94, the distributor 102, and at least portions of the one-way inlet valve 88 and the outlet valve regulator 90 are encased within a housing 82, which may include a handle 84, as illustrated in FIG. 7, to facilitate carrying of the pressure pack 80.

Figure 8:
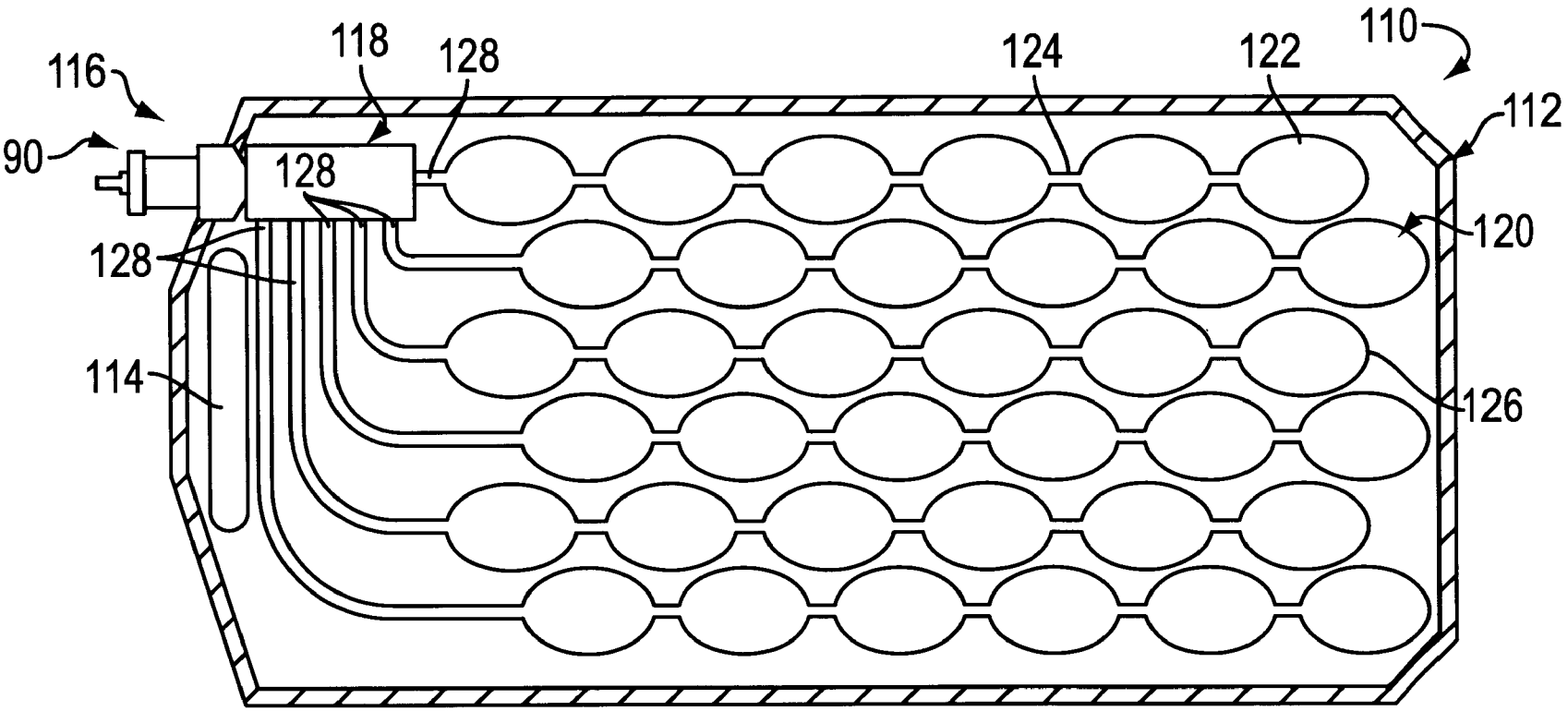
FIG. 8 is still another alternate embodiment of a pressurized fluid pack employing a container system according to the present invention.

In FIG. 8 is shown still another alternative embodiment of a pressure pack generally designated by reference number 110. The pressure pack 110 includes a gas storage vessel comprised of a number of generally parallel strands 120 of hollow chambers 122 serially interconnected by interconnecting conduit sections 124. Each of the strands 120 has a closed end 126 at the endmost of its chambers 122 and an open terminal end 128 attached to a coupling structure defining an inner plenum. In the illustrated embodiment, the coupling structure comprises a manifold 118 to which is pneumatically attached each of the respective terminal ends 128 of the strands 120. Each strand 120 may be connected to the manifold 118 by a threaded interconnection, a crimp, or a swage, or any other suitable means for connecting a high pressure polymeric tube to a rigid fitting. A fluid transfer control system 116 is attached to the manifold 118, and, in the illustrated embodiment, comprises a outlet valve regulator 90 and a one-way inlet valve (not shown).

The hollow chambers of the gas storage vessels described above and shown in FIGS. 5A, 5B, 6, 7, and 8 can be of the type shown in FIGS. 2A and 2B having an internal perforated tubular core, or they can be of the type shown in FIG. 4 having no internal tubular core.

Figure 9A:
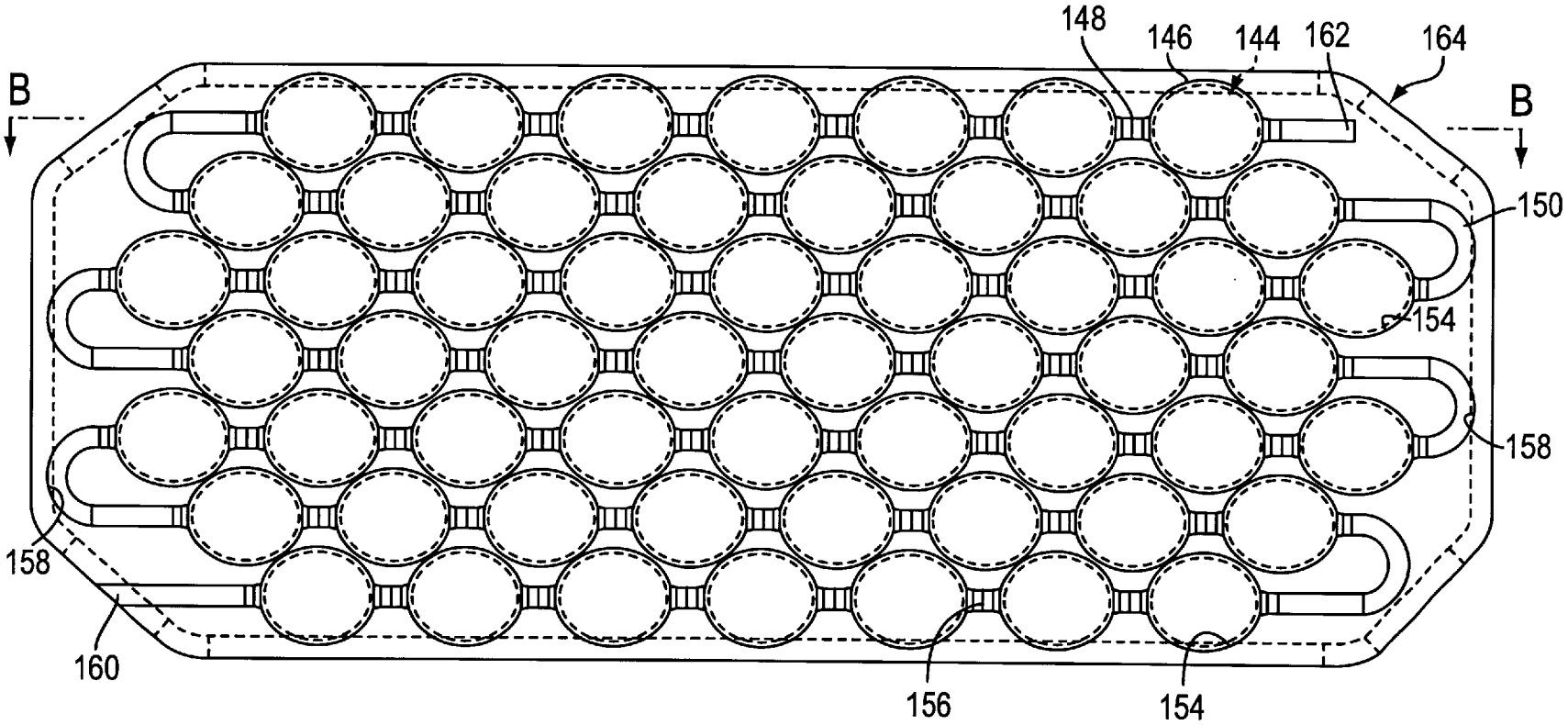
FIG. 9A is a plan view of a container system according to the present invention secured within a conforming shell of a housing for a portable pressurized fluid pack.
Figure 9B:
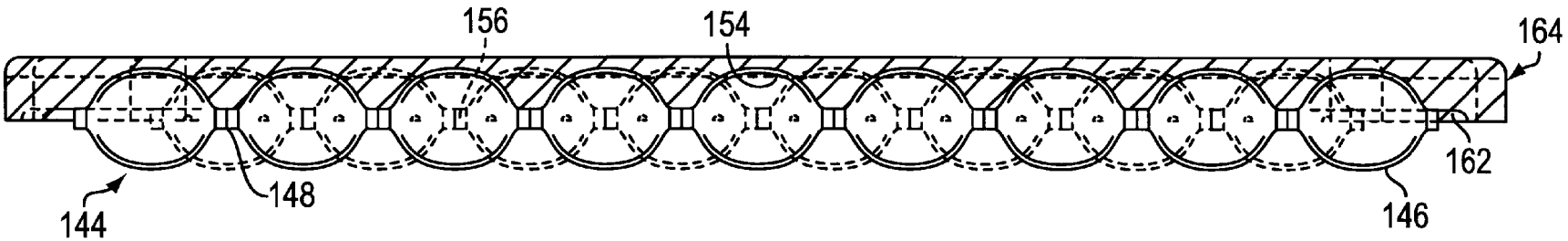
FIG. 9B is a transverse section along the line A—A in FIG. 9A.

FIGS. 9A and 9B show one-half of a foam shell, generally indicated at 164, for encasing a gas storage vessel 144 to form a housing for a portable pressure pack. The gas storage vessel 144 shown in FIG. 9A includes a sinuous arrangement of generally spherical chambers 146 serially interconnected by short interconnecting conduit sections 148 and longer, bendable interconnecting conduit sections 150. The foam shell 164 is preferably a molded synthetic foam "egg crate"

design. That is, the shell 164 includes a plurality of chamber recesses 154 serially interconnected by short, straight interconnecting channels 156 and long, curved interconnecting channels 158. The chamber recesses 154 and the interconnecting channels 156 and 158 are arranged in the preferred arrangement of the chambers 146 and interconnecting conduits 148 and 150 of the gas storage vessel 144. Alternatively, the chamber recesses 154 and interconnecting channels 156, 158 could be configured in other preferred arrangements such as, for example, those arrangements shown in FIGS. 6, 7, and 8. The foam shell 164 may be formed from neoprene padding or a polyurethanebased foam. Most preferably, the foam shell is formed from a closed cell, skinned foam having a liquid impervious protective skin layer. Suitable materials include polyethylene, polyvinyl chloride, and polyurethane. The use of a self-skinning, liquid impervious foam may eliminate the need for the protective synthetic plastic coating 48 (see FIG. 4) applied directly onto the reinforcing filament layer. A fire retardant additive, such as, for example, fire retardant additives available from Dow Chemical, can be added to the foam material of the foam shells.

A second foam shell (not shown) has chamber recesses and interconnecting channels arranged in a configuration that registers with the chamber recesses 154 and the interconnecting channels 156 and 158 of the foam shell 164. The two foam shells are arranged in mutually-facing relation and closed upon one another to encase the gas storage vessel 144. The mating foam shells are thereafter adhesively-attached to one another at marginal edge portions thereof.

Suitable adhesives for attaching the mating foam shell halves include pressure sensitive adhesives.

Figure 10:
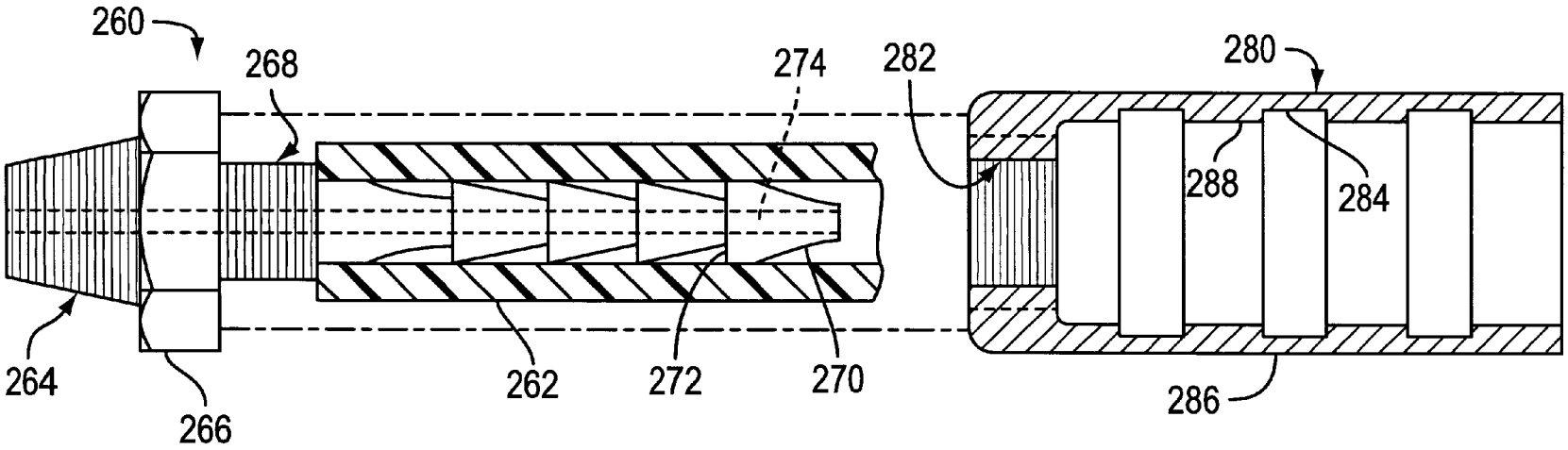
FIG. 10 is a partial, exploded view in longitudinal section of a system for securing a polymeric tube to a mechanical fitting.

FIG. 10 shows a preferred arrangement for attaching a mechanical fitting 260 to a polymeric tube 262 in a manner that can withstand high pressures within the tube 262. Such fittings 260 can be attached to the ends of a continuous strand of serially connected hollow chambers for connecting inlet and outlet valves at the opposite ends. For example, fittings 34 and 36 shown in FIG. 1 could be attached in the manner to be described. The mechanical fitting 260 has a body portion, which, in the illustrated embodiment includes a threaded end 264 to which can be attached another component, such as a valve or a gauge, and a faceted portion 266 that can be engaged by a tool such as a wrench. The body portion is preferably made of brass. End 264 is shown as an exteriorly threaded male connector portion, but could be an interiorly threaded female connector portion. An exteriorly threaded collar 268 extends to the right of the faceted portion 266. An inserting projection 270 extends from the threaded collar 268 and has formed thereon a series of barbs 272 of the "Christmas tree" or corrugated type that, due to the angle of each of the barbs 272, permits the projection 270 to be inserted into the polymeric tube 262, as shown, but resists removal of the projection 270 from the polymeric tube 262. A channel 274 extends through the entire mechanical fitting 260 to permit fluid transfer communication through the fitting 260 into a gas storage vessel.

A connecting ferrule 280 has a generally hollow, cylindrical shape and has an interiorly threaded opening 282 formed at one end thereof. The remainder of the ferrule extending to the right of the threaded opening 282 is a crimping portion 286. The ferrule 280 is preferably made of 6061 T6 aluminum. The crimping portion 286 has internally-formed ridges 288 and grooves 284. The inside diameter of the ridges 288 in an uncrimped ferrule 280 is preferably greater than the outside diameter of the polymeric tube 262 to permit the uncrimped ferrule to be installed over the tube.

Attachment of the fitting 260 to the tube 262 is affected by first screwing the threaded collar 268 into the threaded opening 282 of the ferrule 280. Alternatively, the ferrule 280 can be connected to the fitting 260 by other means. For example, the ferrule 280 may be secured to the fitting 260 by a twist and lock arrangement or by welding (or soldering or brazing) the ferrule 280 to the fitting 260. The polymeric tube 262 is then inserted over the inserting projection 270 and into a space between the crimping portion 286 and the inserting projection 270. The crimping portion 286 is then crimped, or swaged, radially inwardly in a known manner to thereby urge the barbs 272 and the ridges 288 and grooves 284 into locking deforming engagement with the tube 262. Accordingly, the tube 262 is securely held to the fitting 260 by both the frictional engagement of the tube 262 with the barbs 272 of the inserting projection 270 as well as the frictional engagement of the tube 262 with the grooves 284 and ridges 288 of the ferrule 280, which itself is secured to the fitting 260, e.g., by threaded engagement of threaded collar 268 with threaded opening 282.

Figure 11A:
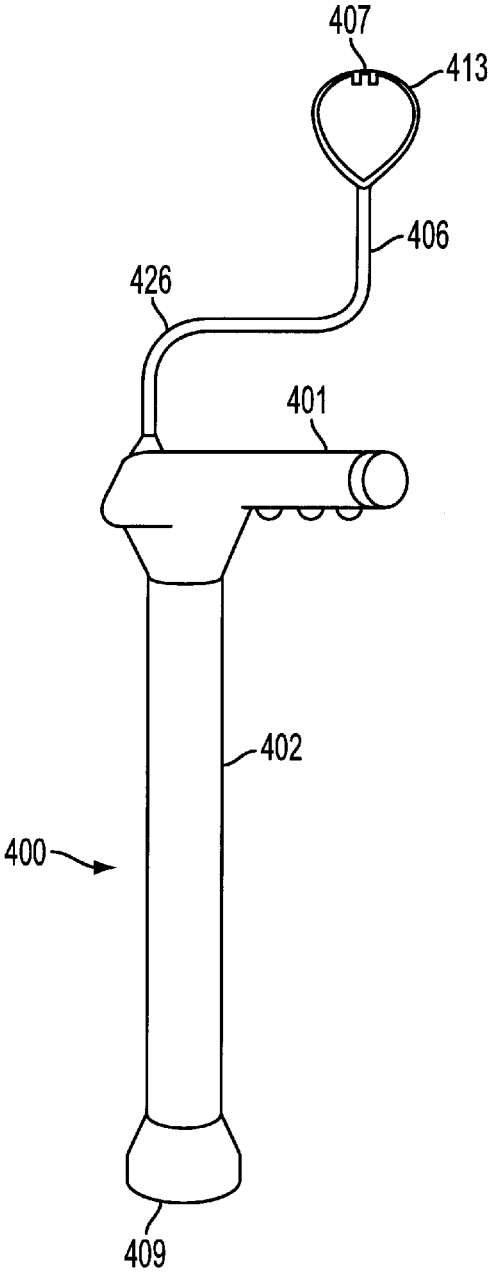
FIG. 11A is a side view of a first embodiment of a walking assistance device according to the present invention.
Figure 11B:
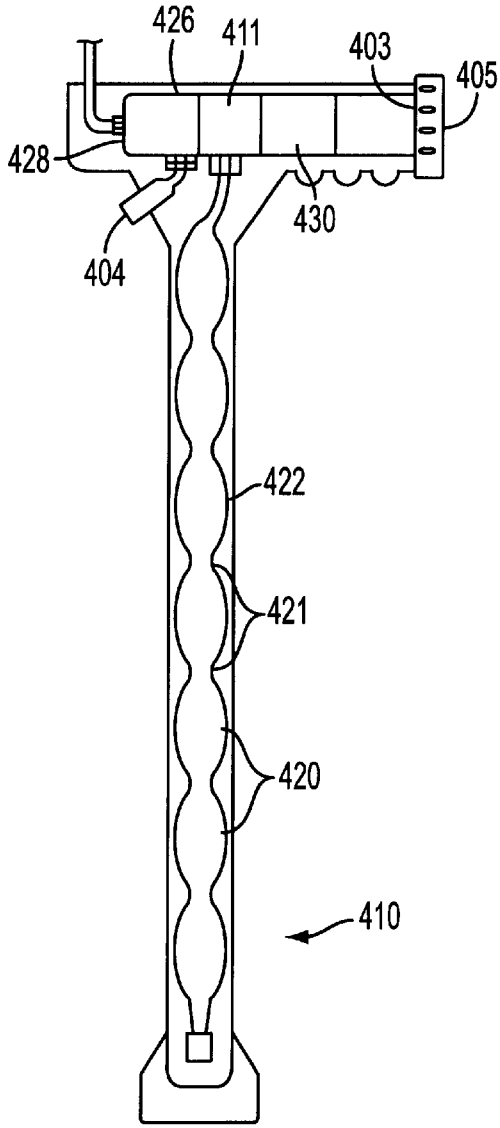
FIG. 11B is a cutaway view of the first embodiment shown in FIG. 11A.

A connecting arrangement of the type shown in FIG. 10 could also be used, for example, for attaching the strands 92 of interconnected chambers to the connecting nipples 104 of the distributor 102 in FIG. 7 or to attach the strands of interconnected chambers 120 to the connecting nipples 138 and 140 of the manifold 118 of FIG. 8. A first embodiment of a walking assistance device constructed according to the present invention is shown in FIGS. 11A and 11B. In this embodiment a gas storage vessel 410 that is comprised of hollow chambers 420 interconnected by conduit sections 421 and wrapped with a reinforcing filament 422 layer, as described above, is incorporated within a support structure 402 of a walking cane 400. The hollow chambers 420 are preferably formed of a polymeric material, and may be of spherical or ellipsoidal shape, as discussed above. The conduit sections 421 are also preferably formed of a polymeric material. The hollow chambers 420 and conduit sections 421 may also, however, be formed of other suitable materials such as monomers or elastomers. The gas storage vessel 410 can have a perforated inner tubular core as shown in FIGS. 2A and 2B, or, in the alternative, it can have no tubular core as shown in FIG. 4. Walking cane 400 may be seen in FIG. 11A to be composed of a handle 401 attached to the support structure 402. As is conventional in the construction of walking canes, a non-skid, impact-absorbing boot 409 may further be affixed to the end of the support structure 402.

The handle 401 and support structure 402 are preferably formed from hollow tubes formed of a strong, lightweight material, such as extruded aluminum or plastic. A manifold 411, to which the gas storage vessel 410 is attached, may be incorporated in the handle 401 or attached to another portion of the support structure 402. A one-way inlet valve 404, which functions as describe above, is attached to the manifold 411. Although the one-way inlet valve 404 is shown in the illustrated embodiment as attached to the manifold 411, it may, in the alternative, be attached to the gas storage vessel 410 directly.

The cane 400 includes a gas delivery system, generally indicated at reference number 426, which is constructed and arranged to deliver gas from the storage vessel 410 to the user in a breathable manner. The gas delivery system 426 includes an outlet valve/regulator 430 constituting a portion of, or carried internally of, the manifold 411, a dual lumen tube 406 connected to an outlet port 428 of the manifold 411, a loop 413 formed from each of the lumens of the dual lumen tube 406, and a breathing apparatus, such as a nasal cannula 407. In a typical application, the loop 413 is wrapped around the head of a user over the tops of the user's ears, and the dual lumen nasal cannula 407 is inserted into the nose of the user. Other breathing apparatuses, such as a mask, a stent, or a needle may also be used.

The outlet valve/regulator 430 is operable to release gas from the gas storage vessel 410 in a regulated, stepped-down manner to the outlet port 428. Preferably, the outlet valve/regulator embodies a pneumatic demand oxygen conservor valve or an electronic oxygen conservor valve. Pneumatic demand oxygen conservor valves are constructed and arranged to dispense a pre-defined volume of low pressure oxygen (referred to as a "bolus" of oxygen) to a patient in response to inhalation by the patient and to otherwise suspend oxygen flow from the gas storage vessel during non-inhaling episodes of the patient's breathing cycle. The structures, function, and operation of pneumatic demand oxygen conservor valves are described in U.S. Pat. No. 5,360,000 and in PCT Publication No. WO 97/11734A1, as well as in U.S. patent application Ser. No. 09/435,174 filed Nov. 5, 1999, the respective disclosures of which are hereby incorporated by reference.

A manually operable flow control knob 405 is attached to an end 403 of the manifold 411 and is operably coupled to the outlet valve/regulator 430 to permit manual adjustment of the rate of flow through the output pressure regulator 430, thereby adjusting the volume and/or rate of gas delivery by the gas delivery system 426. The flow control valve knob 405 is preferably provided at a location that is accessible to the user of the walking cane 400 when the user is walking but is located such that it will not be obtrusive or otherwise cause discomfort to the user.

The dual lumen nasal cannula 407 (or other suitable breathing apparatus) communicates the patient's breathing status through one of the lumens of the dual lumen tube 406 to the outlet valve/regulator 430 and delivers a bolus of oxygen released by the outlet valve/regulator 430 to the patient during inhalation through the other lumen of the dual lumen tube 406. A suitable dual lumen nasal cannula is described in U.S. Pat. No. 4,989,599, the disclosure of which is hereby incorporated by reference.

The use of the cane 400 as a walking assistance device is in any conventional manner, with the user typically grasping the handle 401 while in a generally upright standing position and using the support structure 402 to support at least a portion of the user's weight during at least a portion of a stride as the user walks with the assistance of the cane 400. The dual lumen tube 406 is preferably of a sufficient, but not excessive, length so that the breathing apparatus, such as cannula 407, can be comfortably and not obtrusively worn by the user during otherwise conventional use of the cane 400 as a walking assistance device.

Figure 12A:
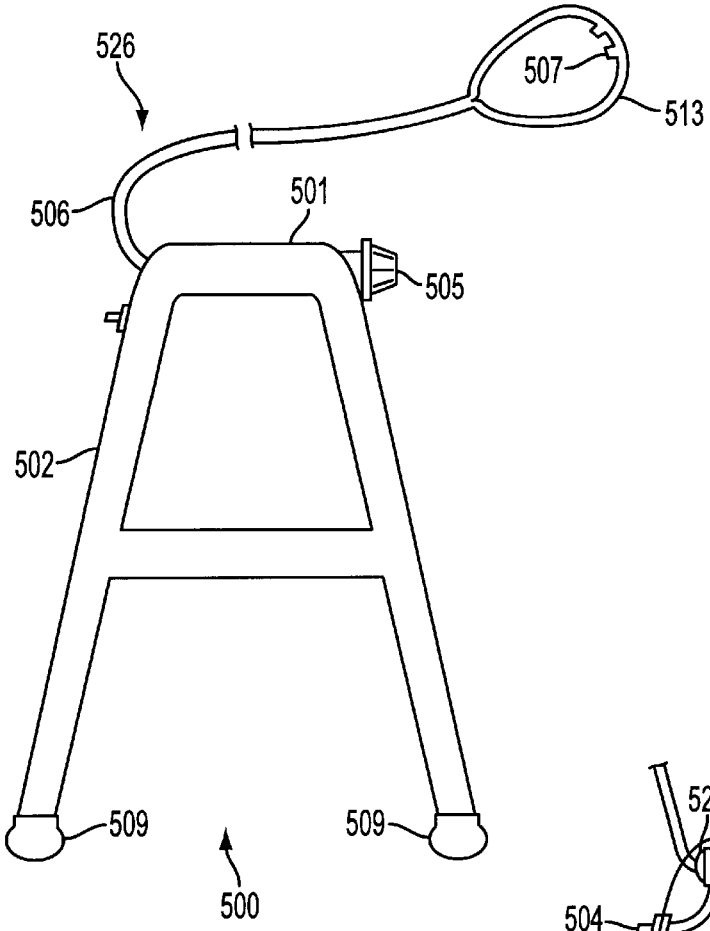
FIG. 12A is a side view of a second embodiment of a walking assistance device according to the present invention.
Figure 12B:
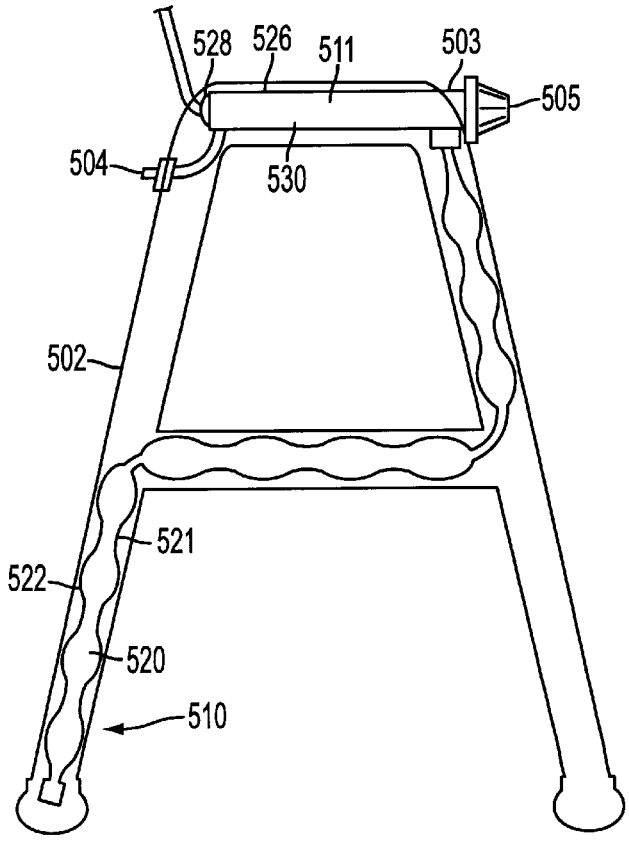
FIG. 12B is a cutaway view of the second embodiment shown in FIG. 12A.
Figure 12C:
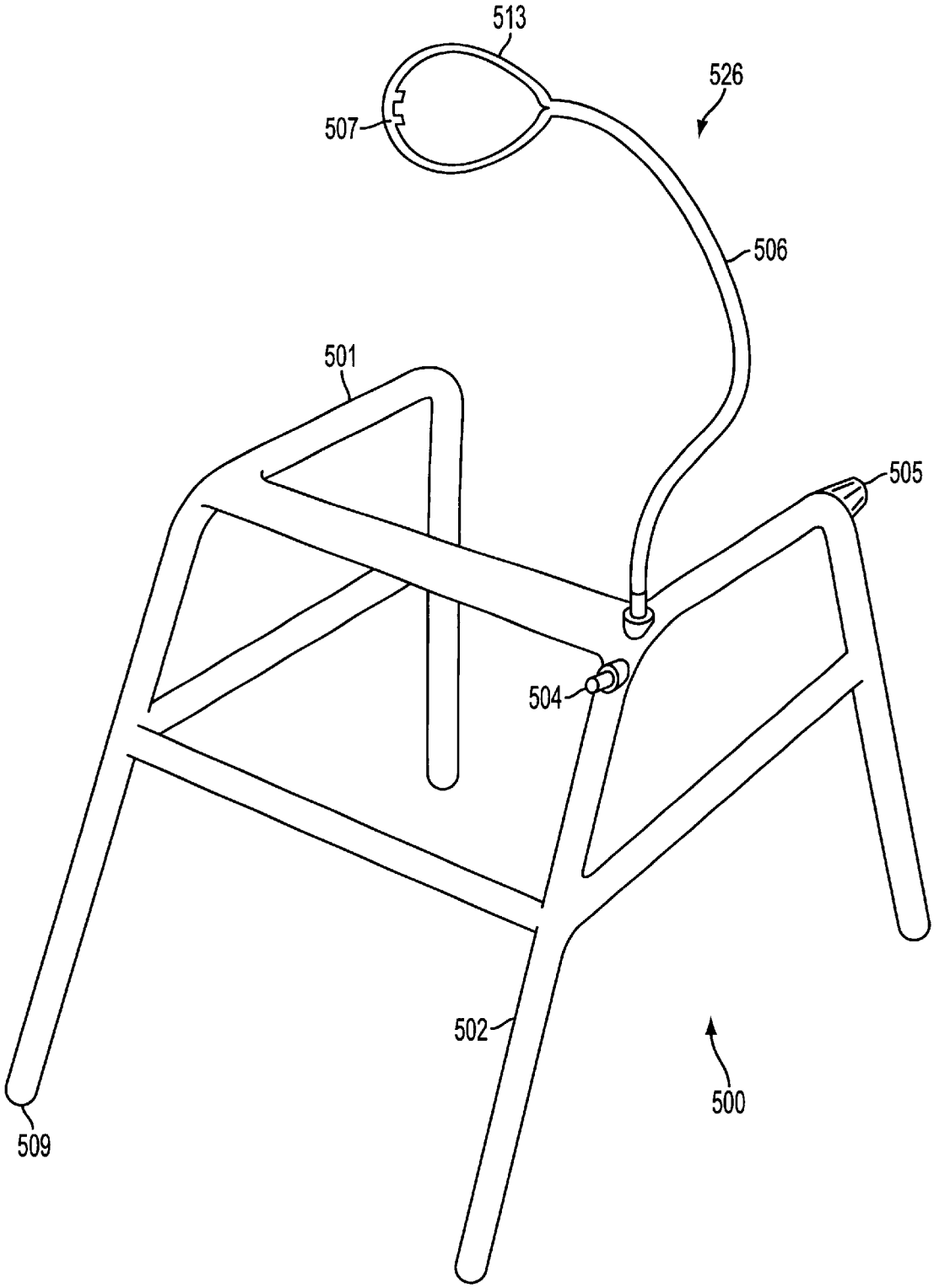
FIG. 12C is an perspective view of the second embodiment.

A second embodiment of a walking assistance device according to the present invention is shown in FIGS. 12A, 12B and 12C. In this embodiment, a gas storage vessel 510 comprised of hollow chambers 520 which are interconnected by conduit sections 521 and wrapped with a reinforcing filament layer 522, as described above, is incorporated within a support structure 502 of a walker 500. An outer protective layer may be provided over the reinforcing filament layer 522. The hollow chambers 520 are preferably formed of a polymeric material, and may be of spherical or ellipsoidal shape, as discussed above. The conduit sections 521 are also preferably formed of a polymeric material. The hollow chambers 520 and conduit sections may also, however, be formed of other materials such as monomers or elastomers. The gas storage vessel 510 can have a perforated inner tubular core as shown in FIGS. 2A and 2B, or, in the alternative, it can have no tubular core as shown in FIG. 4.

Walker 500 may be seen in FIG. 11A to be of generally conventional construction comprising a series of tubular elements formed from a strong and lightweight material, e.g., aluminum or plastic, interconnected to form a frame providing four generally upright legs and transverse cross members interconnecting the legs. Upper cross members define handles 501. As is conventional in the construction of walkers, non-skid, impact-absorbing boots 509 may further be affixed to the ends of the leg portions of the support structure 502. Alternatively, wheels may be provided at the ends of some or all of the legs.

The interconnected chambers 520 of the gas storage vessel 510 are disposed within the hollow tubular members of the support structure 502 as shown. Although gas storage vessel 510 is shown in FIG. 12B to be incorporated in only part of support structure 502, it could be incorporated in additional parts or all of support structure 502, as one skilled in the art would appreciate. Further, gas storage vessel 510 can be in several parts, extending throughout the several frame elements of a walker, connected with appropriate connectors at the intersections of leg portions and cross-member portions of the support structure 502.

A manifold 511 attached to the gas storage vessel 510 may be incorporated in one of the handles 501, or it can be attached to a different portion of the support structure 502. A one-way inlet valve 504, which functions as describe above, is attached to the manifold 511. Although the one-way inlet valve 504 is shown in the illustrated embodiment as attached to the manifold 511, it can, in the alternative, be attached to the gas storage vessel 510 directly.

The walker 500 includes a gas delivery system, generally indicated at reference number 526, which is constructed and arranged to deliver gas from the storage vessel 510 to the user in a breathable manner. The gas delivery system 526 includes an outlet valve/regulator 530 constituting a portion of, or carried internally of, the manifold 511, a dual lumen tube 506 connected to an outlet port 528 of the manifold 511, a loop 513 formed from each of the lumens of the dual lumen tube 506, and a breathing apparatus, such as a nasal cannula 507. In a typical application, the loop 513 is wrapped around the head of a user over the tops of the ears, and the dual lumen nasal cannula 507 is inserted into the nose of the user. Other breathing apparatuses, such as a mask, a stent, or a needle may also be used.

The outlet valve/regulator 530 is operable to release gas from the gas storage vessel 510 in a regulated, stepped-down manner to the outlet port 528. Preferably, the outlet valve/regulator 530 embodies a pneumatic demand oxygen conservor valve or an electronic oxygen conservor valve, as described above.

A manually operable flow control knob 505 is attached to an end 503 of the manifold 511 and is operably coupled to the outlet valve/regulator 530 to permit manual adjustment of the rate of flow through the output valve/regulator 530, thereby adjusting the volume and/or rate of gas delivery by the gas delivery system 526. The flow control valve knob 505 is preferably provided at a location that is accessible to the user of the walking cane 500 when the user is walking but is located such that it will not be obtrusive or otherwise cause discomfort to the user.

As described above, the dual lumen nasal cannula 507 (or other suitable breathing apparatus) communicates the patient's breathing status through one of the lumens of the dual lumen tube 506 to the outlet valve/regulator 530 and delivers a bolus of oxygen released by the outlet valve/regulator 530 to the patient during inhalation through the other lumen of the dual lumen tube 506.

The use of the walker 500 as a walking assistance device is in any conventional manner, with the user typically grasping the handles 501 while in a generally upright standing position and using the support structure 502 to support at least a portion of the user's weight during at least a portion of a stride as the user walks with the assistance of the walker 500. The dual lumen tube 506 is preferably of a sufficient, but not excessive, length so that the breathing apparatus, such as cannula 507, can be comfortably and not obtrusively worn by the user during otherwise conventional use of the walker 500 as a walking assistance device.

Figure 13A:
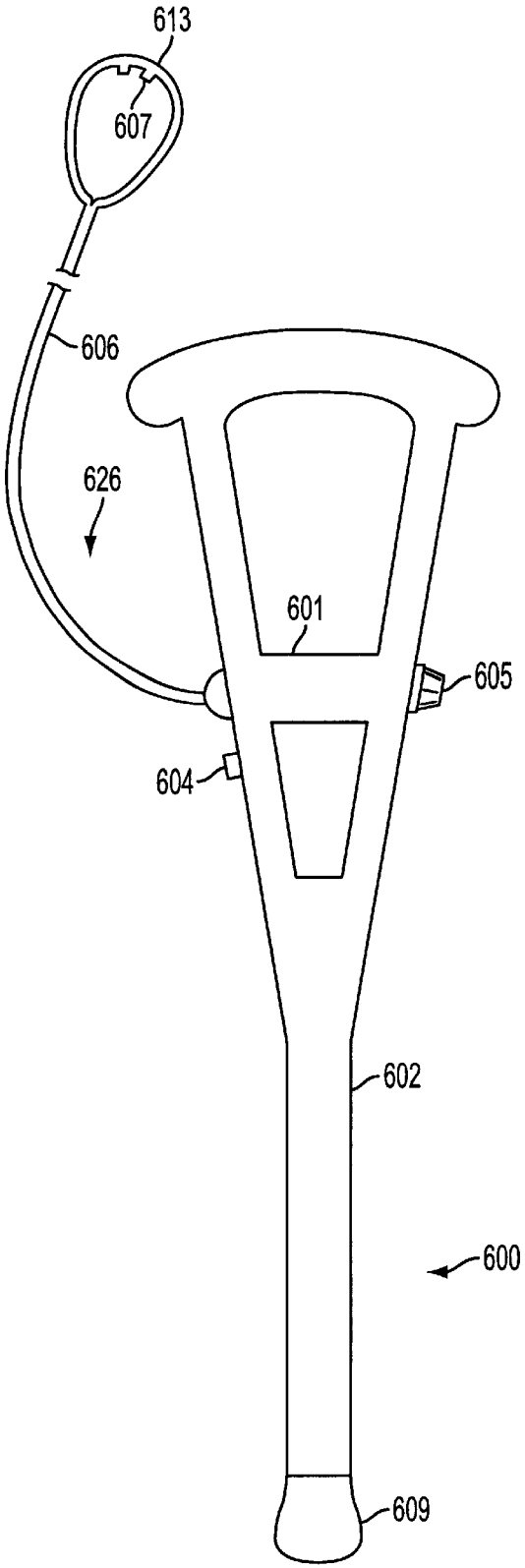
FIG. 13A is a side view of a third embodiment of a walking assistance device according to the present invention.
Figure 13B:
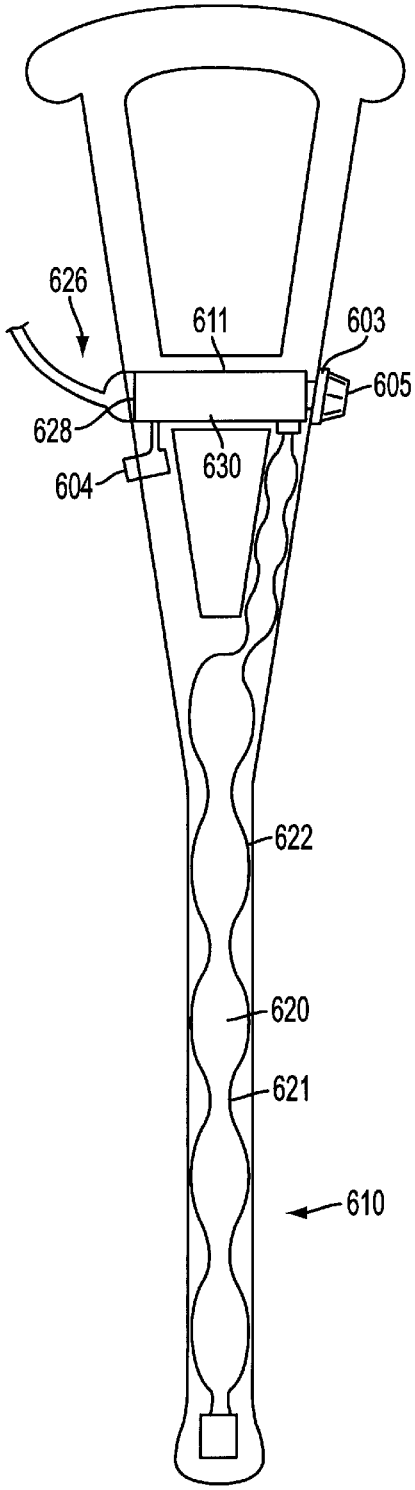
FIG. 13B is a cutaway view of the third embodiment shown in FIG. 13A.

A third embodiment of a walking assistance device according to the present invention is shown in FIGS. 13A and 13B. In this embodiment a gas storage vessel 610 comprised of hollow chambers 620, interconnected by conduit sections 621, and wrapped with a reinforcing filament 622 layer, as described above, is incorporated within a support structure 602 of a walking crutch 600. The hollow chambers 620 are preferably formed of a polymeric material, and may be of spherical or ellipsoidal shape, as discussed above. The conduit sections 621 are also preferably formed of a polymeric material. The hollow chambers and conduit sections may also, however, be formed of other materials such as monomers or elastomers. The gas storage vessel 610 can have a perforated inner tubular core, as shown in FIGS. 2A and 2B, or, in the alternative, it can have no tubular core as shown in FIG. 4.

Walking crutch 600 may be seen in FIG. 11A to be composed of a handle 601 attached to the support structure 602. The handle 601 and support structure 602 are preferably comprised of hollow tubes formed of a strong, lightweight material, such as aluminum or plastic. As is conventional in the construction of walking crutches, a nonskid, impact-absorbing boot 609 may further be affixed to the end of the support structure 602. The crutch 600 may be one of a pair of crutches, either of which, or both of which, may include a gas storage vessel 610, as shown.

The interconnected chambers 620 of the gas storage vessel 610 are disposed within the hollow tubular members of the support structure 602 as shown. Although gas storage vessel 610 is shown in FIG. 13B to be incorporated in only part of support structure 602, it could be incorporated in additional parts or all of support structure 602, as one skilled in the art would appreciate.

A manifold 611 attached to the gas storage vessel 610 may be incorporated in the handle 601, or it can be attached to a different portion of the support structure 602. A one-way inlet valve 604, which functions as describe above, is attached to the manifold 611. Although the one-way inlet valve 604 is shown in the illustrated embodiment as attached to the manifold 611, it can, in the alternative, be attached to the gas storage vessel 610 directly.

The crutch 600 includes a gas delivery system, generally indicated at reference number 626, which is constructed and arranged to deliver gas from the storage vessel 610 to the user in a breathable manner. The gas delivery system 626 includes an outlet valve/regulator 630 constituting a portion of, or carried internally of, the manifold 611, a dual lumen tube 606 connected to an outlet port 628 of the manifold 611, a loop 613 formed from each of the lumens of the dual lumen tube 606, and a breathing apparatus, such as a nasal cannula 607. In a typical application, the loop 613 is wrapped around the head of a user over the tops of the ears, and the dual lumen nasal cannula 607 is inserted into the nose of the user. Other breathing apparatuses, such as a mask, a stent, or a needle may also be used.

The outlet valve/regulator 630 is operable to release gas from the gas storage vessel 610 in a regulated, stepped-down manner to the outlet port 628. Preferably, the outlet valve/regulator 630 embodies a pneumatic demand oxygen conservor valve or an electronic oxygen conservor valve, as described above.

A manually operable flow control knob 605 is attached to an end 603 of the manifold 611 and is operably coupled to the outlet valve/regulator 630 to permit manual adjustment of the rate of flow through the output pressure regulator 630, thereby adjusting the volume and/or rate of gas delivery by the gas delivery system 626. The flow control valve knob 605 is preferably provided at a location that is accessible to the user of the walking cane 600 when the user is walking but is located such that it will not be obtrusive or otherwise cause discomfort to the user.

As described above, the dual lumen nasal cannula 607 (or other suitable breathing apparatus) communicates the patient's breathing status through one of the lumens of the dual lumen tube 606 to the outlet valve/regulator 630 and delivers a bolus of oxygen released by the outlet valve/regulator 630 to the patient during inhalation through the other lumen of the dual lumen tube 606.

The use of the crutch 600 as a walking assistance device is in any conventional manner, with the user typically grasping the handle 601 of each of a pair of crutches while in a generally upright standing position, placing an upper portion of the support structure under the user's arms and using the support structure 602 to support at least a portion of the user's weight during at least a portion of a stride as the user walks with the assistance of the crutch 600. The dual lumen tube 606 is preferably of a sufficient, but not excessive, length so that the breathing apparatus, such as cannula 607, can be comfortably and not obtrusively worn by the user during otherwise conventional use of the crutch 600 as a walking assistance device.

While the invention has been described in connection with what are presently considered to be the most practical and preferred embodiments, it is to be understood that the invention is not to be limited to the disclosed embodiments, but, on the contrary, it is intended to cover various modifications and equivalent arrangements included within the spirit and scope of the appended claims. Thus, it is to be understood that variations in the particular parameters used in defining the present invention can be made without departing from the novel aspects of this invention as defined in the following claims.

What is claimed is:

1. A walking assistance device providing a portable supply of medicinal gas comprising:

a handle adapted to be grasped by a user;

a support structure composed of at least one tube and constructed and arranged to support said handle in a raised position with respect to the ground for grasping by the user while in a generally upright standing position and being further constructed and arranged to support at least a portion of the user's weight during at least a portion of the user's stride; and a gas storage vessel carried within said support structure, said gas storage vessel comprising:

a plurality of hollow chambers;

a plurality of conduit sections, each of said conduit sections being positioned between adjacent ones of said plurality of hollow chambers to interconnect said plurality of hollow chambers, each of said conduit sections having a maximum interior transverse dimension that is smaller than a maximum interior transverse dimension of each of said hollow chambers; and a reinforcing filament wrapped around said hollow chambers and said conduit sections, wherein said gas storage vessel comprises at least one continuous strand of interconnected ones of said plurality of hollow chambers spaced apart by ones of said plurality of conduit sections, said continuous strand being incorporated within said at least one tube.

2. The walking assistance device of claim 1, wherein each of said hollow chambers has a substantially spherical shape.

3. The walking assistance device of claim 1, wherein each of said hollow chambers has a substantially ellipsoidal shape.

4. The walking assistance device of claim 1, wherein each of said hollow chambers is formed from a polymeric material.

5. The walking assistance device of claim 1, wherein each of said conduit sections is formed from a polymeric material.

6. The walking assistance device of claim 1, said gas storage vessel further comprising a liquid impervious protective coating layer formed on said reinforcing filament.

7. The walking assistance device of claim 1, wherein said reinforcing filament comprises aramid fiber.

8. The walking assistance device of claim 1, wherein said hollow chambers are formed from a thermoplastic polyurethane elastomer.

9. The walking assistance device of claim 1, wherein said conduit sections are formed from a thermoplastic polyurethane elastomer.

10. The walking assistance device of claim 1, said gas storage vessel further comprising an inner tubular core extending through each of said plurality of chambers in generally coaxial alignment with said conduit sections, each inner tubular core having formed therein at least one aperture disposed within the interior of each of said chambers.

11. The walking assistance device of claim 1, wherein said handle and said support structure define a walking cane.

12. The walking assistance device of claim 1, wherein said handle and said support structure define a walker.

13. The walking assistance device of claim 1, wherein said handle and said support structure define a walking crutch.

14. The walking assistance device of claim 1, further comprising:

a manifold connected to said gas storage vessel;

a one-way inlet valve communicating with said gas storage vessel and constructed and arranged to permit gas under pressure to be transferred through said one-way inlet valve and into said gas storage vessel and to prevent gas within said gas storage vessel from escaping therefrom through said one-way inlet valve; and an outlet valve/regulator communicating with said gas storage vessel and constructed and arranged to release gas from said gas storage vessel in a stepped-down manner.

15. The walking assistance device of claim 14, further comprising a flow control valve knob incorporated in said handle and operably coupled to said outlet valve/regulator for controlling the flow of gas from said storage vessel through said outlet valve/regulator.

16. The walking assistance device of claim 1, further comprising a gas delivery system constructed and arranged to deliver gas from said gas storage vessel to the user in a breathable manner.

17. The walking assistance device of claim 16, wherein said gas delivery system comprises:

an outlet valve/regulator;

a flexible conduit connected to said outlet valve/regulator; and a nasal cannula connected to said flexible conduit and having tubes constructed and arranged to be inserted into the nares of a user to deliver gas from said gas storage vessel to the nostrils of the user in a breathable manner.

* * * * *